US007003960B2

(12) United States Patent
Eroglu

(10) Patent No.: US 7,003,960 B2
(45) Date of Patent: Feb. 28, 2006

(54) METHOD AND APPLIANCE FOR SUPPLYING FUEL TO A PREMIXING BURNER

(75) Inventor: Adnan Eroglu, Untersiggenthal (CH)

(73) Assignee: ALSTOM Technology LTD, Baden (CH)

( * ) Notice: Subject to any disclaimer, the term of this patent is extended or adjusted under 35 U.S.C. 154(b) by 309 days.

(21) Appl. No.: 10/381,784

(22) PCT Filed: Oct. 3, 2001

(86) PCT No.: PCT/IB01/01819

§ 371 (c)(1),
(2), (4) Date: Mar. 28, 2003

(87) PCT Pub. No.: WO02/29318

PCT Pub. Date: Apr. 11, 2002

(65) Prior Publication Data

US 2004/0029058 A1 Feb. 12, 2004

(30) Foreign Application Priority Data

Oct. 5, 2000 (DE) ..... 100 49 205

(51) Int. Cl.
*F02C 7/22* (2006.01)
*F02C 7/26* (2006.01)

(52) U.S. Cl. ..... 60/776; 60/778; 60/734

(58) Field of Classification Search ..... 60/776, 60/737, 734, 39.281, 778, 786; 431/182
See application file for complete search history.

(56) References Cited

U.S. PATENT DOCUMENTS 4,112,676 A * 9/1978 DeCorso ..... 60/733
4,598,553 A * 7/1986 Saito et al. ..... 60/733
4,603,548 A * 8/1986 Ishibashi et al. ..... 60/773

(Continued)

FOREIGN PATENT DOCUMENTS

DE 44 46 945 7/1996

(Continued)

OTHER PUBLICATIONS

International Search Report, issued by the European Patent Office, for PCT Appl. No. PCT/IB01/01819, mailed Dec. 28, 2001.

(Continued)

*Primary Examiner*—Cheryl J. Tyler
*Assistant Examiner*—William H. Rodriguez
(74) *Attorney, Agent, or Firm*—Cermak & Kenealy LLP; Adam J. Cermak

(57) ABSTRACT

A method and an appliance are described for supplying fuel to a premixing burner for operating a gas turbine, which premixing burner has at least one burner shell (1, 2) at least partially bounding an axially extending premixing burner space, having a premixing gas supply directed into the premixing burner space via the burner shell (1, 2), the premixing gas (6) being mixed with combustion inlet air and being ignited downstream external to the premixing burner, The invention is characterized by the fact that the premixing gas supply is carried out separately by means of at least two spatially axially separated regions (S1, S2) along the burner shell (1, 2), having a region (S1), which is arranged upstream, and at least a second region (S2), which is arranged downstream, by the fact that more than 60% of the total premixing gas supply takes place via the first region (S1) in order to start the gas turbine, and by the fact that a stepwise or continuous redistribution of the premixing gas supply to the second region (S2) takes place for the further run-up of the load on the gas turbine to full load.

11 Claims, 4 Drawing Sheets

U.S. PATENT DOCUMENTS

Figure 1:
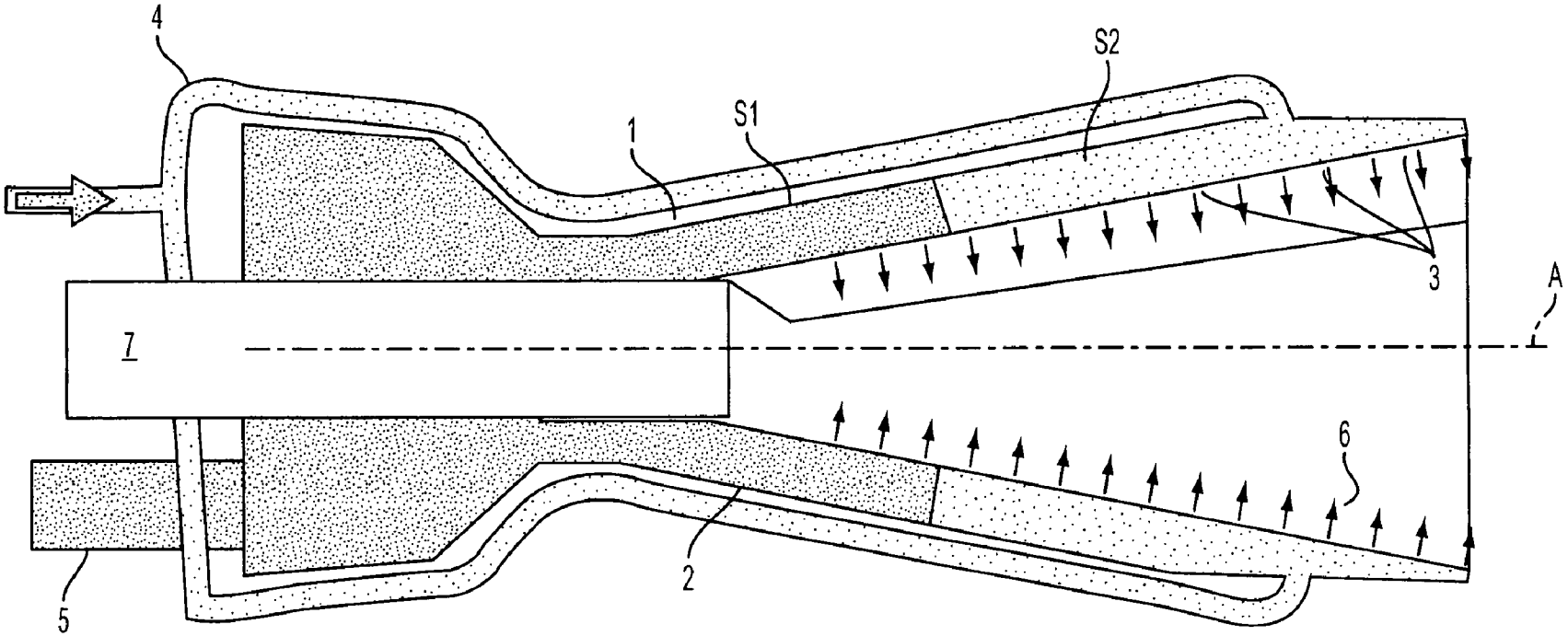

| | | | | | |
|---|---|---|---|---|---|
| 4,735,052 | A | * | 4/1988 | Maeda et al. | 60/733 |
| 4,932,861 | A | * | 6/1990 | Keller et al. | 431/8 |
| 5,013,236 | A | * | 5/1991 | Khinkis | 431/10 |
| 5,085,575 | A | * | 2/1992 | Keller et al. | 431/8 |
| 5,193,995 | A | * | 3/1993 | Keller et al. | 431/351 |
| 5,482,457 | A | * | 1/1996 | Aigner et al. | 431/351 |
| 5,588,826 | A | * | 12/1996 | Dobbeling et al. | 431/354 |
| 5,645,410 | A | * | 7/1997 | Brostmeyer | 431/10 |
| 5,674,066 | A | * | 10/1997 | Hausermann et al. | 431/173 |
| 5,806,299 | A | * | 9/1998 | Bauermeister et al. | 60/776 |
| 5,832,732 | A | * | 11/1998 | Knopfel et al. | 60/760 |
| 5,857,320 | A | * | 1/1999 | Amos et al. | 60/776 |
| 6,098,406 | A | * | 8/2000 | Bolis et al. | 60/737 |
| 6,331,109 | B1 | * | 12/2001 | Paikert et al. | 431/350 |
| 6,418,725 | B1 | * | 7/2002 | Maeda et al. | 60/776 |
| 6,558,154 | B1 | * | 5/2003 | Eroglu et al. | 431/8 |
| 6,640,545 | B1 | * | 11/2003 | Ruck et al. | 60/737 |
| 6,672,863 | B1 | * | 1/2004 | Doebbeling et al. | 431/350 |
| 6,769,903 | B1 | * | 8/2004 | Eroglu et al. | 431/8 |
| 2001/0023578 | A1 | * | 9/2001 | Braun et al. | 60/39.03 |
| 2002/0033014 | A1 | * | 3/2002 | Endo et al. | 60/39.281 |
| 2002/0189257 | A1 | * | 12/2002 | Steinbach et al. | 60/723 |
| 2004/0088996 | A1 | * | 5/2004 | Eroglu et al. | 60/776 |

FOREIGN PATENT DOCUMENTS

| | | |
|---|---|---|
| DE | 44 46 945 A1 | 7/1996 |
| EP | 0 321 809 | 6/1989 |
| EP | 0 592 717 | 4/1994 |
| EP | 0 592 717 A1 | 4/1994 |
| EP | 0 554 325 B1 | 7/1995 |
| EP | 0 918 190 | 5/1999 |
| WO | WO93/17279 | 9/1993 |

OTHER PUBLICATIONS

Search Report from DE 100 49 205.3 (Jan. 12, 2004).

* cited by examiner

METHOD AND APPLIANCE FOR SUPPLYING FUEL TO A PREMIXING BURNER

This is a U.S. national stage application of International Application Number PCT/IB01/01819, filed Oct. 3, 2001, published as WO 02/29318 in German, and claims priority to German application number 100 49 205.3, filed Oct. 5, 2000.

TECHNICAL FIELD

The invention relates to a method and an appliance for supplying fuel to a premixing burner for operating a gas turbine, which premixing burner has at least one burner shell at least partially bounding an axially extending premixing burner space, having a premixing gas supply directed into the premixing burner space via the burner shell, the premixing gas being mixed with combustion inlet air and being ignited downstream, external to the premixing burner.

PRIOR ART

Premixing burners of the previously mentioned generic type for the operation of gas turbine installations are sufficiently known and have different premixing burner geometries. As an example, a conical premixing burner consisting of a plurality of burner shells, a so-called double-cone burner, is described in EP 0 321 809 B1. Its burner shells are combined in such a way that tangential air inlet slots for the combustion inlet air are formed along the burner center line. On the burner shell inlet edges formed by this means, outlet openings for the premixing gas, which are arranged with a distribution in the direction of the burner center line, are provided. The injection of the premixing gas through the outlet openings along the burner shell inlet edges of the leads, because of the burner shell geometry, in association with the combustion inlet air, to a swirl-shaped thorough mixing of the premixing gas and the combustion inlet air.

Another premixing burner geometry is shown in WO 93/17279 in which the premixing burner is configured with an additionally conical inner body. In this case also, the premixing gas is fed into the interior of the premixing burner via corresponding outlet openings, which are arranged along the axially extending air inlet slots, the premixing gas being thoroughly mixed with the combustion inlet air in the interior of the premixing burner and being brought to ignition downstream within the combustion chamber.

Now, it is possible to undertake optimization with respect to the quality of the combustion by appropriate selection of the arrangement, size and number of the outlet openings and by appropriate selection of their distance apart. As an example, it is particularly possible to influence decisively the emission values, the extinguishing behavior of the flame forming in the combustion chamber, the flame reverse flow behavior and the flame stability by appropriate selection of the parameters mentioned above.

The optimization possibilities described above rapidly reach their limits, however, where it is desired to take measures to optimize the burner behavior otherwise than in the case of a permanently specified burner geometry and in the case of an ideal combustion condition. In the case of a specified design arrangement of outlet openings along certain regions of the burner shells, for example, it is almost impossible to keep the combustion behavior to an almost constant optimum level in the case of different load and environmental conditions. It has been found that an optimized arrangement of outlet openings for the premixing gas supply within the premixing burner, which has been designed in optimum manner for use in a certain type of machine, for example for use on an annular combustion chamber, can only be utilized inefficiently or at all for use in another machine type, for example for use in a silo combustion chamber.

In the course of the use of a burner, furthermore, creeping burner system changes occur which are caused by fatigue phenomena and lead, for example, to an increase in leakage airflows. Due to the permanently specified arrangement of the premixing gas passage openings, which themselves are subject to no or only negligible ageing phenomena, however, no compensation can be provided for the changes due to ageing so that a deterioration in the combustion process with increasing operating time of the burner is unavoidable.

Existing premixing gas supply systems are, as a rule, optimized, with respect to low emission values and damped occurrence of combustion oscillations, for the medium and high load region of gas turbines. Pilot stages are usually employed in order to start the combustion process and attain the medium load range of the gas turbine. Pilot gas is usually fed centrally, relative to the premixing burner center line, into the interior of the premixing burner by means of a burner lance. This pilot gas is mixed with the combustion inlet air and brought to ignition. It is only after a certain load range has been attained that the pilot gas supply is switched off and the premixing gas supply put into operation. Such a switching procedure, in which the premixing gas supply is switched off and the pilot gas supply is switched on, takes place in the same manner when the gas turbine is being run down. A high level of combustion oscillation, however, occurs within the burner system during the switching processes; these are associated with strong pressure fluctuations which in turn involve a direct and disturbing effect on the loading behavior of the gas turbine which, as a consequence, is subjected to large load oscillations.

If a gas supply system is switched off, during both run-up and run-down of the gas turbine, it is necessary to clean the switched-off gas supply lines with inert gas in order to exclude flash-back in the supply line and to avoid damage to it. The quantity of inert gases necessary for cleaning the gas supply line is substantial and also leads not least to high operating costs for such burner systems.

Finally, it is almost impossible—using the currently known premixing burners—to operate the premixing burner with different types of fuel such as, for example, liquid or gaseous fuel, particularly because the burner lance for the supply of pilot gas, which is usually arranged centrally in the burner center line (this pilot gas being necessary, as previously mentioned, for running up the gas turbine and for the lower load range), is arranged in the direct spatial vicinity of the central liquid fuel nozzle. It is impossible to exclude undesired ignition interaction between the two fuel outlets.

PRESENTATION OF THE INVENTION

The invention is based on the object of further developing a method and an appliance for the fuel supply to a premixing burner, as described in the preamble to claim 1 and the preamble to claim 8, in such a way that the disadvantages of the prior art, as listed above, may be avoided. In particular, measures should be taken at the premixing burner so that an optimized adaptation of the premixing burner behavior is made possible over the complete load range of the gas turbine. This should, in particular, take place without large-scale technical and design complication and so that it can be realized at only small cost.

The solution to the object on which the invention is based is given in claim 1 and claim 8. Features advantageously developing the concept of the invention are the subject matter of the subclaims and the description and are, in particular, to be extracted with reference to the figures.

The idea on which the invention is based is the axially staged supply of premixing gas along the flanks of the burner shells, the burner shells being subdivided into at least two regions arranged axially one behind the other, which regions are respectively supplied by means of premixing gas supply lines conducted separately from one another. The regions separated from one another along the burner shells are arranged axially one behind the another in the flow direction of the premixing burner, it being recognized, according to the invention, that in order to start the gas turbine, more than 60% of the total premixing gas supply should take place via the upstream first region and the a stepwise or continuous redistribution of the premixing gas supply to the downstream regions adjacent to the first region takes place for the further run-up of the load of the gas turbine to full load.

The axial subdivision of the premixing gas supply along the burner shells of the premixing burner and, in particular, the stepwise supply of the individual regions with premixing gas makes it possible to dispense completely with the supply of pilot gas, even in the case of starting and in the lower load regions of the gas turbine.

A number of advantages which not least follow from the disappearance of the combustion chamber oscillations associated with the switching from pilot gas to a premixing gas supply are associated with the possibility of dispensing with a pilot gas stage. The mode of operation of the premixing burner according to the invention makes it possible, for the first time, to operate a gas turbine from starting to full load without a pilot gas stage. The continuous or stepwise switching-on of individual regions, via which the premixing gas can pass to the interior of the premixing burner, takes place with the aid of open-chain or closed-loop control units provided in the individual supply lines. In the simplest case, these units are configured as controllable throttle valves.

Advantageously dispensing with a pilot gas supply makes it possible, in particular, to atomize liquid fuel by means of a central injection nozzle penetrating into the mouth of the burner, which liquid fuel is in turn surrounded, in an appropriate manner, by a tubular configuration of combustion airflow.

An embodiment configured according to the invention for the targeted supply-flow control of premixing gas for the premixing burner shells, which are subdivided into different regions, is indicated in the following description, with reference to the figures. Essential aspects of the method according to the invention and of the appliance described in detail below is the separate, metered premixing gas supply to the individual regions, arranged axially one behind the other, along the burner shells, by means of which the premixing gas is injected into the interior of the premixing burner.

BRIEF DESCRIPTION OF THE INVENTION

Figure 2:
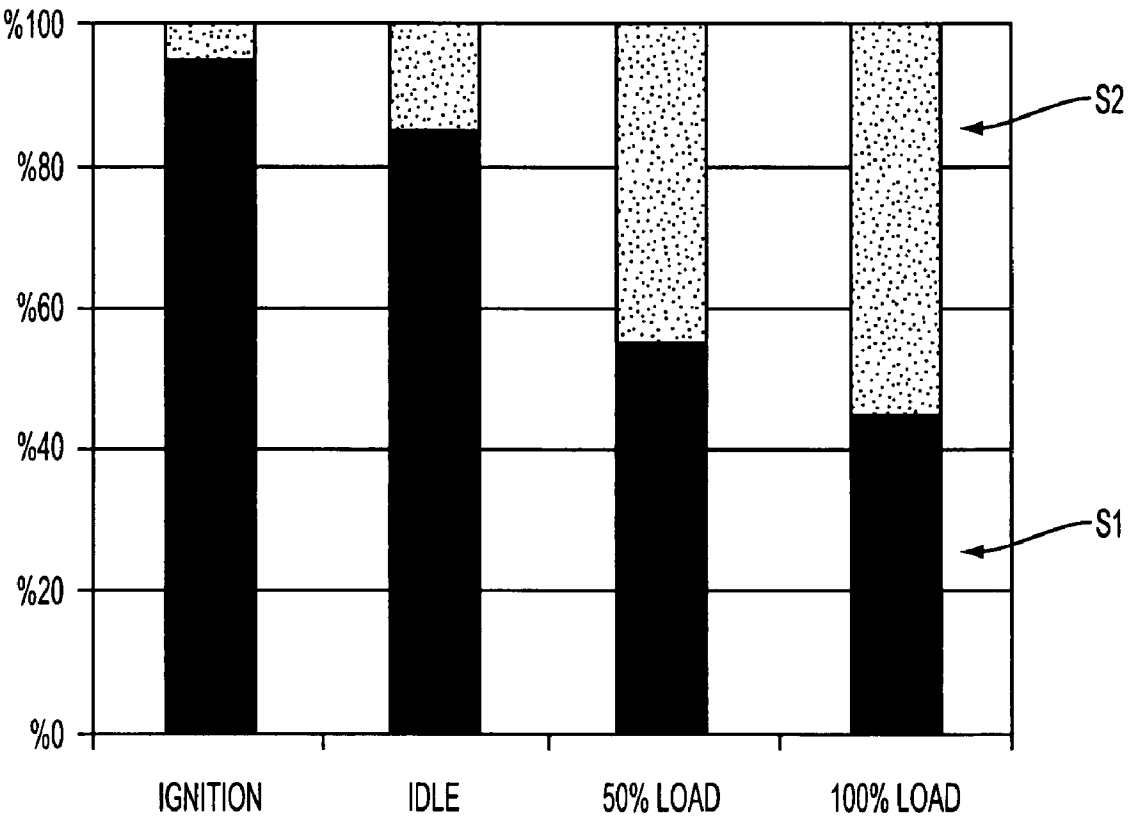
Figure 3:
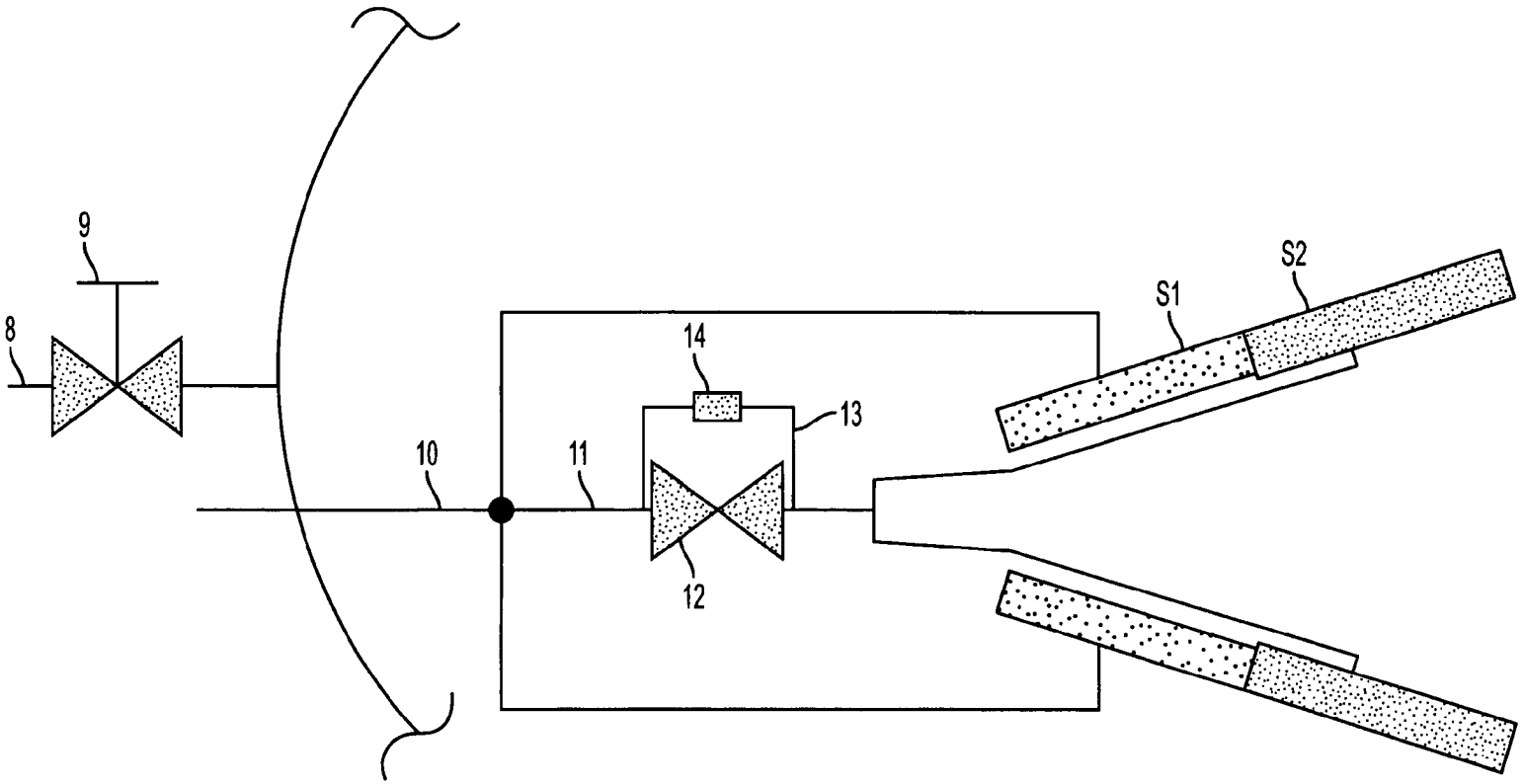
Figure 4:
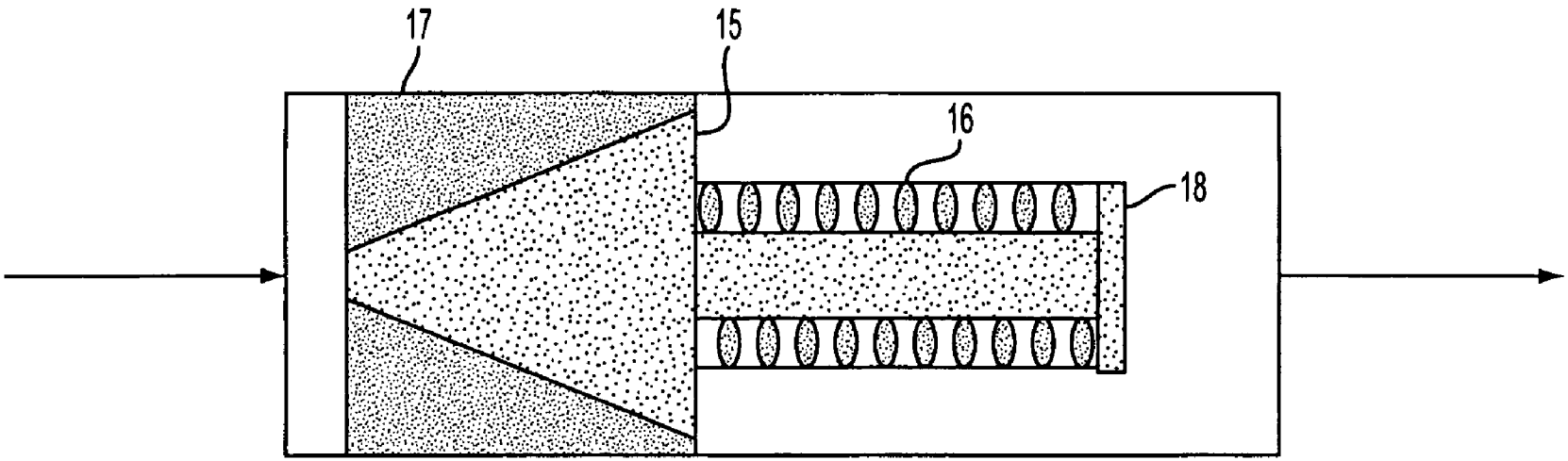

The invention is described as an example below, without limitation to the general idea of the invention, using exemplary embodiments and with reference to the drawing. In the drawing:

FIG. 1 shows a diagrammatic, cross-sectional representation through a premixing burner with a conical configuration, FIG. 2 shows a diagrammatic representation relating to the mode of operation of the exemplary embodiment represented in FIG. 1, FIG. 3 shows a diagrammatic plan relating to the run of supply lines for the supply of premixing gas to the premixing burner, FIG. 4 shows a exemplary embodiment of a control valve.

WAYS OF IMPLEMENTING THE INVENTION, COMMERCIAL APPLICABILITY

FIG. 1 presents a diagrammatic representation of a longitudinal section through a premixing burner with a conical configuration. The premixing burner has conically configured burner shells 1, 2, along which outlet openings 3 are provided in the axial direction relative to the burner longitudinal center line A, through which outlet openings 3 premixing gas can be fed into the interior of the premixing burner. The burner shells 1, 2 are subdivided into two differently separated regions Stage S1, Stage S2, which are supplied with premixing gas by different premixing gas supply lines 4, 5. Inlet air is guided into the interior of the premixing burner through air inlet slots (not represented in FIG. 1) likewise tangentially in the direction of the conical shape and is blended with the premixing gas 6 to form a fuel/air mixture.

A liquid fuel atomization direction 7, which permits a mixed operation or a switch-over from gaseous fuel to liquid fuel, can be optionally provided in the center of the premixing burner. The supply of liquid fuel takes place by means of an atomization nozzle, known per se, which generates a conically propagating atomization cloud within the premixing burner. For protection relative to the premixing outlet openings 3 and for shape stabilization purposes, the propagating liquid fuel cloud is surrounded by a protective air shroud.

No predoping, as is usual in the prior art, is undertaken in order to start the gas turbine, i.e. in order to ignite the premixing burner, but, [lacuna] two-stage premixing burner unit represented in the exemplary embodiment, each region of the burner shell is provided with a premixing gas supply which is arranged upstream within the premixing burner. In the exemplary embodiment, this is the Stage 1 region, which is operated with more than 60% of the total premixing gas supply for starting and for operating the premixing burner in the low 8 load range.

FIG. 2 shows a general view diagram in which the percentage distribution of the premixing gas subdivision between region S1 and region S2 can be seen. The fields shown in black correspond to the proportion of the premixing gas emerging via the region 1, the lighter fields respectively showing the premixing gas proportion which passes into the interior of the burner via the region S2 of the premixing burner. As already mentioned above, the lion's share, i.e. more than 90%, of the total premixing gas supply flows via the region 1 into the interior of the premixing burner during ignition. In the lower load region (idle), the proportion of the premixing gas emerging via the region 2 increases slightly. In the case of the half-load condition, the two regions S1 and S2 are supplied with approximately equal parts of premixing gas. During full-load operation, rather more premixing gas passes into the interior of the premixing burner via the region S2 than via the region 1. The premixing gas allocation to the regions S1 and S2, as represented in FIG. 2, takes place by means of a control unit, which can undertake, stepwise or continuously, the distribution ratio for the premixing gas allocation to the regions S1 and S2. In the simplest case, these are coupled throttle valves, which are respectively provided in the individual supply lines 4 and 5.

A further possibility for the controlled premixing gas supply to the separated regions of the premixing burner can be seen in the diagrammatic representation of FIG. 3. The exemplary embodiment of FIG. 3 again involves a conical premixing burner, which has available two regions S1 and S2, by means of which separated premixing gas enters the interior of the premixing burner. In a common supply line 8, by means of which premixing gas is supplied to the premixing burner, a main control valve 9 is provided. The direct supply of premixing gas to the region S1 of the premixing burner can be controlled by means of the main control valve 9. A crossing point 10, at which part of the premixing gas can be diverted into a supply branch 11, is provided in the supply line between the main control valve 9 and the outlet region S1 of the premixing burner. A further control unit in the form of an overpressure valve 12, which is subjected to spring force and which is described in more detail below with reference to FIG. 4, is provided in the supply branch 11. A bypass line 13, whose flow cross section is small enough, or within which a corresponding throttling element 14 is provided, ensures that a small premixing gas flow can be supplied to the region S2 of the premixing burner when the control valve 12 is closed.

The supply system for premixing gas to the two regions S1 and S2 of the premixing burner, as represented in FIG. 3, has the following mode of operation. After the main control valve 9 has been opened, the region S1 of the premixing burner is supplied with premixing gas. The gas pressure within the supply lines supplying the region S1 with premixing gas, and also in the supply line 11, is not yet capable of opening the overpressure valve, which is subjected to spring force. Only a small proportion of the premixing gas passes via the bypass line 13 to the region S2 of the premixing burner and there emerges into the interior of the premixing burner. This corresponds to the condition when starting the gas turbine or when igniting the premixing burner. After the starting phase, the premixing gas pressure present in the supply line 11 increases. This premixing gas pressure is capable of continuously opening the throttle valve 12, which is subjected to spring force, so that a continually increasing proportion of the premixing gas flowing through the main control valve 9 flows through the overpressure valve 12 into the region S2. If the supply line gas pressure increases further, the overpressure valve 12 opens completely so that a large proportion of the premixing gas can pass into the region S2 of the premixing burner. It is possible to optimize the behavior of the premixing burner with respect to emissions and oscillation behavior by the dimensioning of the supply lines and by the setting of the demand behavior of the overpressure valve 13. By this means, it is possible to realize a premixing burner for operating a gas turbine over the whole of the load range without the necessity for a pilot gas supply and while using only one single control valve, namely the overpressure valve 12.

Such an overpressure valve is represented as an advantageous embodiment in FIG. 4. The overpressure valve 12 has a conically configured piston 15 which, subjected to spring force by a spring 16, is in gas-tight contact with a mating contour 17. If the piston 15 is subjected to pressure by means of gas pressure (on this point, see arrow on the left-hand side of the throttle valve), the gas pressure acting on the piston 15 is capable of compressing the spring 16 against a stop 18. In this process, a gap opens between the piston 15 and the mating contour 17, so that gas can penetrate to the right through the overpressure valve. Depending on the selection of the spring force of the spring element 16 and the dimensioning of the piston size, the premixing gas flow rate through the overpressure valve 12, which depends on gas pressure, can be individually set. With the aid of appropriate dimensioning of the overpressure valve 12 and the supply lines 11 and 14 participating in the premixing gas supply, it is possible to optimize the combustion process in a manner known per se. In the case of the embodiment example represented in FIG. 3, it is also possible to obtain a specified premixing gas distribution between Stages S1 and S2 of the burner shells of the premixing burner according to the representation in the diagram of FIG. 2.

A number of disadvantages are associated with the method and appliance, according to the invention, for the supply of fuel to a premixing burner. Due to the stepped premixing gas supply into the premixing burner, the latter can be employed within the significantly larger range limits as compared with premixing burners which are designed with only one stage.

Only one single premixing gas supply line is necessary using the embodiment represented in FIG. 3.

Due to the use of a control unit configured as an overpressure valve, only one single control unit is necessary for operating the premixing burner.

The retrofitting of the method according to the invention on already existing premixing burner systems can be easily carried out, in particular because the use of two or more separate premixing gas supply systems is unnecessary.

Due to the targeted supply of a minimum proportion of premixing gas into the second region of the premixing burner via the bypass line, it is not necessary to clean this supply line with natural gas. Tests have shown that the system according to the invention only causes slight pulsations in the starting behavior. By means of the individual premixing gas distribution to the different regions of the premixing burner, it is possible to undertake corresponding optimization procedures even in the case where ageing phenomena appear.

Because it is possible to dispense with a pilot gas supply, any pulsations which occur when switching between pilot gas and premixing gas supply can be avoided.

The complete appliance is simple in design and can be manufactured at favorable cost.

LIST OF DESIGNATIONS

| | |
|---|---|
| 1, 2 | Burner shells |
| 3 | Premixing gas outlet openings |
| 4, 5 | Supply lines |
| 6 | Premixing gas |
| 7 | Liquid fuel atomization device |
| 8 | Supply line |
| 9 | Main control unit |
| 10 | Crossing point |
| 11 | Branch line |
| 12 | Overpressure valve |
| 13 | Bypass line |
| 14 | Throttle element |
| 15 | Piston |
| 16 | Spring |

-continued

| | |
|---|---|
| 17 | Mating contour |
| 18 | Stop |
| S1, S2 | Regions 1, 2 for the staged premixing gas outlet |

What is claimed is:

1. A method for supplying fuel to a premixing burner for operating a gas turbine, the premixing burner having at least one burner shell which at least partially bounds an axially extending premixing space, and a premixing gas supply directed into the premixing space via the burner shell, the premixing gas being mixed with combustion inlet air in the premixing space and being ignited downstream, external to the premixing burner, and the premixing gas supply being carried out separately by at least two spatially axially separated regions along the burner shell, including a first region which is arranged upstream, and at least a second region which is arranged downstream, the method comprising:

supplying more than 60% of the total premixing gas via the first region to start the gas turbine; and supplying a stepwise or continuous redistribution of the premixing gas to the second region for the run-up of the load on the gas turbine to full load.

2. The method as claimed in claim 1, wherein supplying the premixing gas to the first region and to the second region comprises mutually independently supplying.

3. The method as claimed in claim 1, comprising, under full-load conditions, supplying at least 50% of the total premixing gas supplied to the premixing burner via the second region or the regions located downstream.

4. The method as claimed in claim 1, wherein the premixing burner comprises conically configured portions and includes at least two burner shells which are arranged relative to one another in such a way that they respectively bound two air inlet slots through which the combustion air enters a conically widening premixing burner space, wherein the first region of the burner shells, through which at least part of the premixing gas is fed into the premixing burner space, is arranged in the region of the narrowest conical cross section and extends into the premixing burner region which widens cross section.

5. The method as claimed in claim 1, wherein supplying premixing gas comprises supplying premixing gas via separate supply lines to the individual, axial separated regions.

6. The method as claimed in claim 1, wherein supplying premixing gas to the individual regions comprises mutually independently supplying.

7. The method as claimed in claim 1, wherein supplying premixing gas to the individual regions comprises supplying by a single control unit.

8. An appliance for supplying fuel to a premixing burner for operating a gas turbine, the premixing burner having at least one burner shell which at least partially bounds an axially extending premixing space and a premixing gas supply directed into the premixing space via the burner shell, at least two spatially separated regions provided axially along the burner shell, via which regions premixing gas can be fed into the premixing space, a first region provided in the burner shell arranged upstream in the premixing burner, at least a second region arranged which is arranged downstream of the first region in the premixing burner, the appliance comprising:

a premixing gas supply line for the first region;

a premixing gas supply line for the second region;

a control unit for the first region and second region gas supply lines, the control unit comprising a closed-loop or open-chain control unit;

wherein the premixing gas supply of the first region comprises a throttle valve;

a crossing point between the throttle valve and the first region;

a supply line leading from the crossing point to the second region; and wherein the control unit is provided between the crossing point and the second region.

9. The appliance as claimed in claim 8, wherein the control unit comprises an overpressure valve including a spring.

10. The appliance as claimed in claim 8, further comprising:

a bypass line provided between the crossing point and the second region, which bypass line ensures a minimum supply of premixing gas to the second region provided that the first region is supplied with premixing gas.

11. A premixing burner useful for operating a gas turbine, comprising:

at least one burner shell which at least partially bounds an axially extending premixing space;

a premixing gas supply directed into the premixing space via the burner shell;

at least two spatially separated regions provided axially along the burner shell, via which regions premixing gas can be fed into the premixing space, a first region provided in the burner shell arranged upstream in the premixing burner, and at least a second region arranged downstream of the first region in the premixing burner; and an appliance according to claim 8, the premixing gas supply connected to the first region gas supply line and to the second region gas supply line.

* * * * *

UNITED STATES PATENT AND TRADEMARK OFFICE

CERTIFICATE OF CORRECTION

PATENT NO. : 7,003,960 B2
DATED : February 28, 2006
INVENTOR(S) : Adnan Eroglu et al.

It is certified that error appears in the above-identified patent and that said Letters Patent is hereby corrected as shown below:

Title page,
Item [75], Inventors, delete and replace with the following:
-- Adnan Eroglu, Untersiggenthal (CH)
Peter Stuber, Zuerich (CH) --.

Signed and Sealed this

Ninth Day of May, 2006

JON W. DUDAS
*Director of the United States Patent and Trademark Office*